US006637906B2

(12) United States Patent
Knoerzer et al.

(10) Patent No.: US 6,637,906 B2
(45) Date of Patent: Oct. 28, 2003

(54) ELECTROLUMINESCENT FLEXIBLE FILM FOR PRODUCT PACKAGING

(75) Inventors: Anthony Robert Knoerzer, Plano, TX (US); Garrett William Kohl, Allen, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 09/951,875

(22) Filed: Sep. 11, 2001

(65) Prior Publication Data

US 2003/0048635 A1 Mar. 13, 2003

(51) Int. Cl.[7] ..... F21V 33/00
(52) U.S. Cl. ..... 362/84; 362/156
(58) Field of Search ..... 362/154, 155, 362/156, 267, 84, 310; 313/506, 511; 428/68, 690, 917

(56) References Cited

U.S. PATENT DOCUMENTS

| | | | | |
|---|---|---|---|---|
| 4,687,968 A | * | 8/1987 | Frayer | 313/509 |
| 4,708,914 A | * | 11/1987 | Kamijo | 428/690 |
| 4,861,632 A | | 8/1989 | Caggiano | |
| 4,926,296 A | | 5/1990 | Blume et al. | |
| 5,067,063 A | | 11/1991 | Granneman et al. | |
| 5,268,827 A | | 12/1993 | Granneman et al. | |
| 5,545,069 A | | 8/1996 | Glynn et al. | |
| 5,552,679 A | * | 9/1996 | Murasko | 315/169.3 |
| 5,567,054 A | | 10/1996 | Dalgleish | |
| 5,676,451 A | | 10/1997 | Tabanera | |
| 5,770,920 A | * | 6/1998 | Eckersley et al. | 315/506 |
| 5,833,070 A | | 11/1998 | Mizuno et al. | |
| 5,860,724 A | | 1/1999 | Cheng | |
| 5,874,155 A | | 2/1999 | Gehrke et al. | |
| 5,976,613 A | * | 11/1999 | Janusauskas | 427/66 |
| 6,270,834 B1 | * | 8/2001 | Burrows | 427/166 |
| 6,298,990 B1 | | 10/2001 | Amrod et al. | |
| 6,432,516 B1 | * | 8/2002 | Terasaki et al. | 428/195 |

OTHER PUBLICATIONS

Technology Watch article entitled, "Little Future in Electronics," Popular Mechanics, Jan. 2001, p. 22. (1 page).
SEIKO Precision article entitled "Electro Luminescence" found on Jan. 30, 2001 at http://www.seiko–precision.com/html/el_co.htm (4 pages).
Amcon International article entitled "LUXLED electro luminescence technique" found at http://www.amcon–luxled.com/luxled/technic 1.htm, Dec. 31, 2000. (9 pages).
World Producers, Inc. Light Emitting Diodes article entitled "A growing number of applications" found on Jan. 30, 2001 at http://www.worldproducts.com/home/wpi/ppg/ell/ell02t.htm. (10 pages).
Power Paper Ltd. article entitled "MK3B Power Paper Cell" found at http://www.powerpaper.com/techDataText2.html, Jun. 2000. (1 page).

(List continued on next page.)

*Primary Examiner*—Thomas M. Sember
(74) *Attorney, Agent, or Firm*—Colin P. Cahoon; Carstens, Yee & Cahoon, L.L.P.

(57) ABSTRACT

A flexible electroluminescent film, and packaging material and packages made therefrom, that incorporates electroluminescent material within the polymer packaging film layers to enable the film to be illuminated without an external light source. The film may also comprise various thin-film items, such as power source, inverter, switch, integrated circuit, radio receiver, and speaker, all within the film layers. The film can be used in existing form and fill packaging machines without substantial modifications to the machines.

20 Claims, 4 Drawing Sheets

OTHER PUBLICATIONS

Drawing of Electrode found at http://www.powerpaper.com/batteryStructureText.html, Jun. 2000. (1 page).

Flexible Circuit Technologies, Inc. article entitled "Membrane Switches & Graphic Overlays" found on Jun. 21, 2001 at http://www.flexetech.com/membrane.htm. (2 pages).

Home Page for Memtronik Innovations, including article on Membrane Switches, found at http://www.memtronik.com/start1.htm, Apr. 28, 1998. (8 pages).

Metromark, Inc. article entitled "Membrane Switches and Graphic Overlays That Perform as Well as They Look" found at http://www.metromark.com/membrane.htm, 1998. (1 page).

Home Page for Memtronik Innovations, including article entitled "Electroluminescents" found at http://www-.memtronik.com/start1.htm, Oct. 6, 1998. (6 pages).

Oak Ridge National Laboratory article entitled "Thin Film Rechargeable Lithium Battery" found at http://www.ornl.gov/ORNLTech/battery.html, Feb. 1994. (2 pages); Jan. 2001 Popular Science Article entitled "Paper Thin Power" (1 page).

Jan. 2001 Popular Science Article entitled "Paper Thin Power" (1 page).

* cited by examiner

FIG. 3
(PRIOR ART)
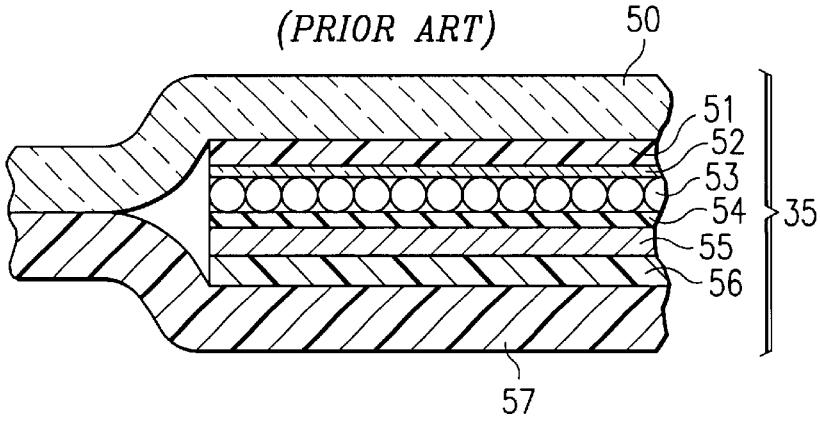
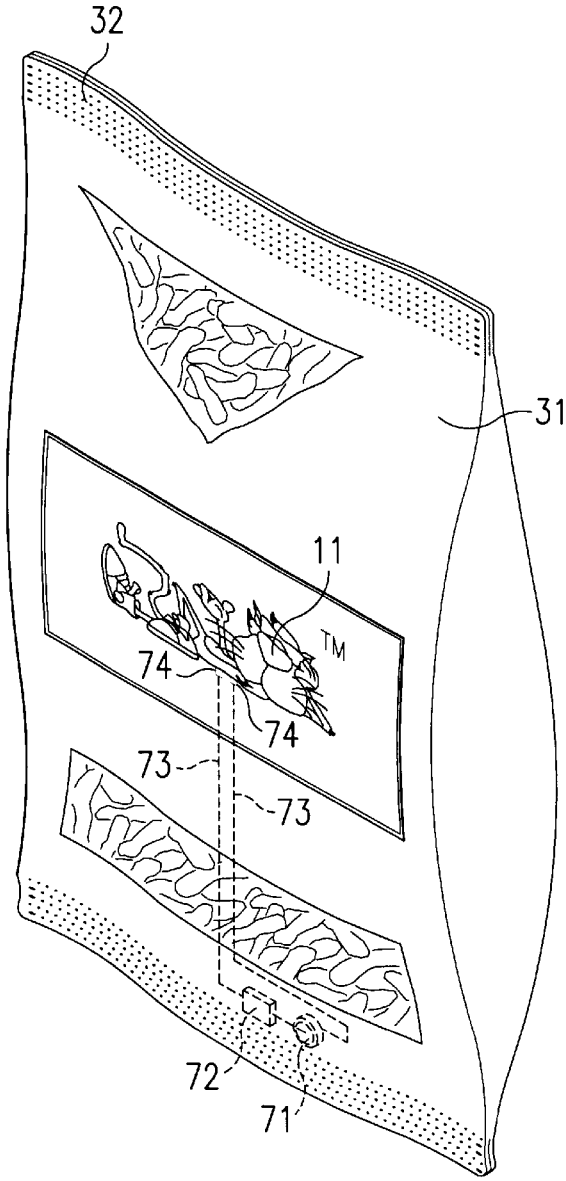
FIG. 4

ELECTROLUMINESCENT FLEXIBLE FILM FOR PRODUCT PACKAGING

BACKGROUND

1. Technical Field

The present invention relates to electroluminescent flexible films incorporated into food or other product packaging. This invention allows product packaging to be illuminated without substantially increasing film thickness or substantially decreasing the film flexibility necessary to conform to varying product shapes. More specifically, this invention can be used with existing product-packaging equipment, such as a vertical form, fill, and seal machine, to incorporate electroluminescent displays into product packaging. More generally, this invention can be used in any product requiring illuminated thin films or illuminated images on thin films.

2. Description of Related Art

There are several examples of embodiments of illuminations on various containers in the prior art. Such designs allow for increased visibility of a design imprinted on the container in dark conditions. Further, illuminated containers are more likely to grab the viewer's attention than non-illuminated containers. Illuminating decorative designs helps emphasize illuminated parts, much like underlining helps emphasize marked text.

Prior art devices typically utilize bulky light sources for illumination. For example, U.S. Pat. No. 5,567,054 uses a chemiluminescent "wand" disposed within a pouch at the base of a bag. The wand consists of two concentric tubes filled with two different chemicals that produce light when mixed. This wand illuminates the bag when the inner, frangible tube is broken to allow the two chemicals to interact. However, the bag requires an additional pouch to contain the wand. The manufacturing process for making the bag would thus require additional manufacturing steps for forming the pouch, placing the wand into the pouch, and heat-sealing the pouch.

A handbag with a removable electroluminescent lamp was disclosed in U.S. Pat. Nos. 5,067,063 and 5,268,827. Electroluminescent technology is discussed in further detail below in reference to U.S. Pat. No. 5,676,451. The electroluminescent lamp used in that invention can illuminate both inside and outside the bag. The lamp, however, must be manually attached to the inside wall of the bag by some mechanical means, such as Velcro or clips. To mass-produce the handbags, additional labor steps would be required to attach the lamp to the inside wall. Alternatively, a separate machine would be needed to make the attachment. Furthermore, the bag requires a separate compartment to contain the battery and DC-to-AC converter. The attachment of an electroluminescent lamp and the addition of the batteries, a converter, a switch, the wiring, and containers to house those materials would unnecessarily decrease the amount of space available inside the bag.

Similarly, U.S. Pat. No. 4,926,296 discloses an illuminated carrying bag with a light bulb attached to a sidewall. Batteries contained in a pouch secured to that sidewall energize the light bulb. Like the invention disclosed in the '063 and '827 patents, the illuminating device in the '296 patent is bulky and requires extra labor and/or equipment to incorporate into existing bags.

In another prior art reference, U.S. Pat. No. 5,676,451, a fabric bag is illuminated with a flexible electroluminescent film strip attached to the exterior of the bag. Electroluminescence is a light emission phenomena resulting from the application of an electric field to prepared phosphor powders sandwiched between sheet-metal electrodes. Electroluminescent strips function with alternating current (AC). Voltage is applied between the front and the back electrode by way of an AC power source and the phosphor particles are excited by the electric field, thereby producing a luminescent energy. The film strip disclosed in the '451 Patent is energized by a battery and inverter (DC-to-AC converter), both of which are contained in a pouch. Although the electroluminescent film strip is flexible in the preferred embodiment of the '451 patent and can conform to the changing shape of the bag walls, the electroluminescent film strip still is not part of the wall itself; it still must be mechanically attached. Furthermore, the power source requires its own pouch.

Prior to the current invention, no other invention incorporated electroluminescent materials into self-contained, flexible packaging films for use with product packaged in flexible film packages, such as snack food packaged using a vertical form, fill, and seal machine. Consequently, a need exists for flexible electroluminescent films suitable for use with existing film-packaging equipment or other uses requiring flexible electroluminescent films, such as packaging for chips and other snack food products. Such films should be easily manufactured and readily adaptable to existing form and fill machines. Further, such invention should save space and reduce the necessary amount of raw materials by eliminating the need to attach a separate, exterior light source to the packaging film.

Prior art methods utilized attached light sources that were prone to detachment from shifting container contents or rough handling. Consequently, a need exists for a light source for containers that is not prone to detachment. By incorporating the light source within the packaging film instead of merely attaching it onto the film, such invention would prevent the light source from being knocked loose during shipping or handling. The invention should also be flexible in order to withstand the deformation of containers that occurs during normal shipping and handling.

SUMMARY OF THE INVENTION

The proposed invention comprises a flexible electroluminescent film, and packaging derived therefrom, in combination with other elements capable of illuminating graphic designs contained within the film layers. The invention can be used as flexible packaging material and can be used in traditional packaging devices. All the necessary components for illumination are incorporated within a thin film sheet.

In one embodiment of the invention, the flexible electroluminescent film is incorporated within the layers of a bag used to hold chips or other snack food products. Electroluminescent material is sandwiched within various polymer, ink, and moisture-absorbing layers. A thin-film DC power source, a thin-film current inverter, and a thin-film touch-sensitive switch ("power system") are all incorporated within the layers of the packaging material. Thus, a single sheet of film incorporating all these features can be fed into a vertical form, fill, and seal machine. The electroluminescent material, various ink layers, and opaque mask layers are arranged in such a manner as to illuminate a graphics image on the formed bag when the power system is activated.

The invention is a great improvement over the prior art for a number of reasons. Incorporating the light source into the enclosure material itself instead of attaching a separate light source saves interior space and leaves more room for product to be enclosed. Having the packaging and light source all in one piece also avoids the problem of having attachments that can be knocked loose during shipping or handling. It also avoids the problem of enclosed items snagging or catching onto the light and/or the power system.

Importantly, having the light source and power system already incorporated into a film sheet saves time and expense for packaging facilities. Whereas prior art solutions required extra machinery and/or labor to attach electroluminescent lamps, no such additions are necessary with this invention. The sheet comprising the flexible electroluminescent film can be assembled on a film converter and used in existing form, filling, and sealing packaging systems for existing product lines.

Incorporating the electroluminescent layers into the packaging layers saves raw material costs by preventing the duplication of materials. In prior art systems involving electroluminescent lamps separately attached to packaging walls, both the lamp and the packaging walls required their own moisture-trapping layers. Because the electroluminescent layers are within the packaging layers, only one set of moisture-trapping layers is necessary.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 3 is a cross-section view of a prior art flexible electroluminescent film incorporated in one embodiment of the present invention;

FIG. 4 is a perspective view of the flexible electroluminescent film of one embodiment of the present invention incorporated into a snack food bag showing several components attached to the packaging walls;

DETAILED DESCRIPTION

Figure 1:
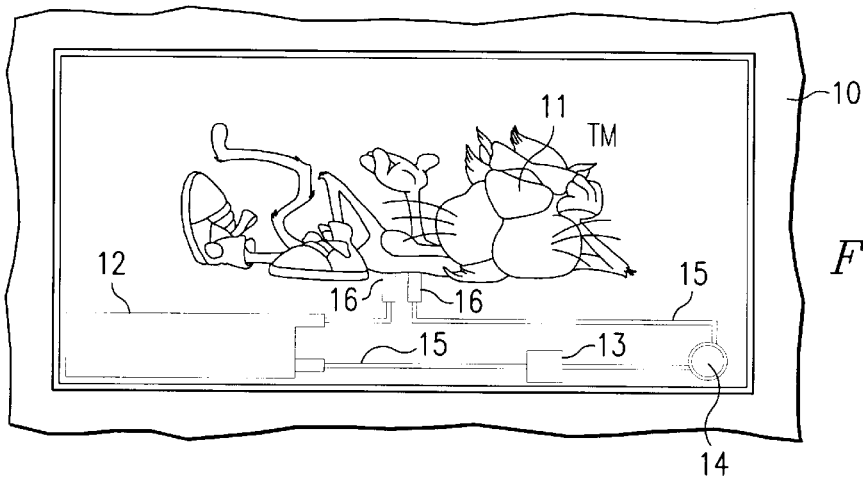
FIG. 1 is a schematic view of flexible electroluminescent film components in one embodiment of the invention.

FIG. 1 illustrates a schematic view of one preferred embodiment of the flexible film sheet 10 incorporating the electroluminescent features of the present invention. This figure highlights important features of the sheet 10, including: an electroluminescent graphic design 11 incorporated into the film; a thin-film battery 12, a thin-film current inverter 13, a thin-film touch-sensitive switch 14, and other printed circuitry 15, all of which are incorporated within the film layers. When the user touches the switch 14, current flows from the battery 12 to the current inverter 13 where the DC current is converted into AC. Then the current continues through the closed switch 14 and to electrodes 16 that lead into the electroluminescent layer. Once the electric current reaches the electroluminescent layer, the layer energizes and the image 11 illuminates. The current then returns to the battery 12.

The components of the flexible film sheet 10 in FIG. 1 are not limited to the physical locations displayed in FIG. 1. For example, the power system, which includes the battery 12, switch 14, and inverter 13, might be located far away from the image 11, with circuitry 15 connecting the image 11 to the more distant power system. Also, the components may or may not be visible to the user. Certain areas of the film sheet 10 may contain opaque layers that hide various components from sight. There may, for example, be an ink layer covering the battery 12 and inverter 13 so that the user only sees the switch 14 and the image 11. Color variations on the image 11 can be accomplished by covering areas of the image with different colored layers or by incorporating electroluminescent film giving off different colors.

In addition, not all of the components may be necessary; alternatively, additional or different components may also be incorporated. For example, if the image 11 is to be illuminated continuously for as long as the battery 12 lasts, then a switch 14 will not be necessary. If more current or more voltage is needed, several batteries 12 might be incorporated into the film 10 in series or in parallel. It is also possible to have several electroluminescent images within the same piece of flexible film sheet 10. All that would be required is that the printed circuitry 15 be arranged in such a way as to supply all images with current. Other components, such as an integrated circuit 91 as shown in FIG. 5*b,* might be incorporated into the film sheet 10 in order to control the manner of illumination. An integrated circuit 91, for instance, might control which of several different images or portions of a single image illuminate and also control when they illuminate in order to create an interesting visual effect.

Figure 2A:
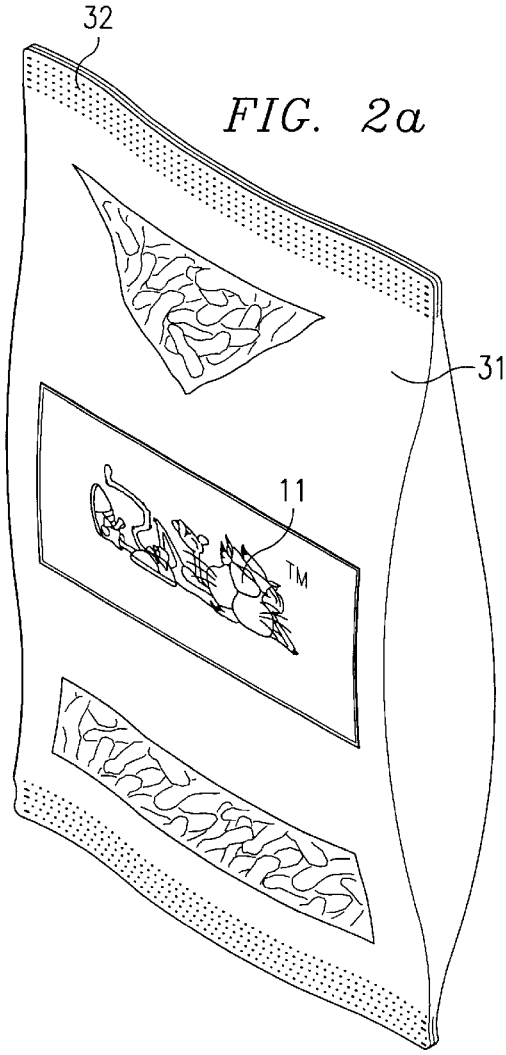
FIGS. 2*a* and 2*b* are perspective views of the flexible electroluminescent film of one embodiment of the present invention incorporated into a snack food bag.
Figure 2B:
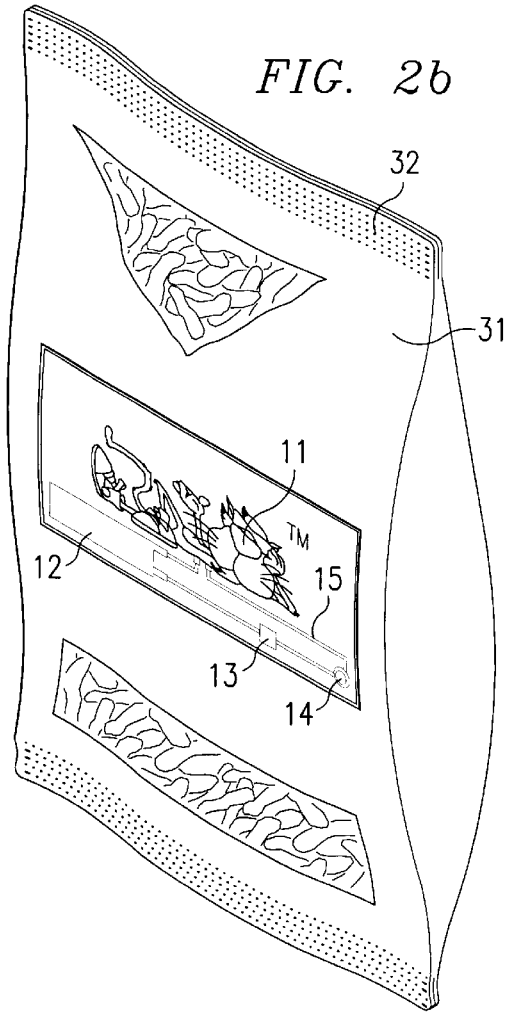

FIGS. 2*a* and 2*b* depict the flexible film sheet 10 with electroluminescent features incorporated into the packaging of a snack food bag. Corresponding reference numerals are used to represent corresponding elements unless indicated otherwise. Only the electroluminescent image 11 is visible in FIG. 2*a*, whereas all the power components, such as the battery 12, inverter 13, switch 14, and circuitry 15, are visible in FIG. 2*b*. In FIG. 2*a*, opaque ink layers within the film layers cover the layers containing the battery 12, inverter 13, switch 14, and circuitry 15. The polymer layers covering the electroluminescent material layer and power component layers may contain portions that are opaque while other portions are transparent. Thus, one can selectively choose which portions of the various components are to be visible and which ones are to be hidden.

The electroluminescent image 11 does not have to be confined to the area as shown in FIGS. 2*a* and 2*b*. Several images may be spread throughout the bag or packaging 31; each image may be powered by its own power components, or by a common power source. One suitable power source is the MK3B Power Paper Cell, manufactured by Power Paper of Kibutz Einat, Israel. The power components also do not have to be confined to the area as shown in the figures. For instance, the portion of the packaging film 31 containing the battery 12 might be located near the top or bottom of the bag, or even within the seams 32 of the bag. The portions of the film containing the circuitry 15 might be located near the perimeter of the bag in order to make the components more visibly appealing. In addition, the essential elements for illumination, namely the front and rear electrode layers 52, 55 and the electroluminescent material layer 53, as shown in FIG. 3, do not have to be present throughout the entire packaging film 31. Those elements are only necessary in the illuminable portions of the film and do not have to be present in non-illuminable portions. Companies such as Memtronic of Montreal, Canada, and SEIKO Precision of the United Kingdom, manufacture electroluminescent material suitable for use with the layers comprising the instant invention.

Although the preferred embodiment of the invention is in a snack food bag as shown in either FIG. 2*a* or FIG. 2*b*, the invention can also be used in any application requiring flexible electroluminescent films. For example, the invention might be used for packaging pharmaceuticals, pet foods, liquids, and any other number of products that can be marketed in a flexible package. Further, such invention can be used for a number of other point-of-sale applications and advertising applications, such as billboards, posters, and displays, where the electroluminescent film arrangement of the Applicants' invention can be substituted for the paper or thin film presently used in such applications.

FIG. 3 depicts in further detail a prior art combination of various layers comprising the flexible electroluminescent film 35 of one embodiment of the invention. In this embodiment, the electroluminescent film 35 is made of eight layers: an outer sealing layer 50, an outer desiccant layer 51, a front electrode 52, electroluminescent material layer 53, insulation 54, rear electrode 55, an inner desiccant layer 56, and inner sealing layer 57. The inner and outer sealing layers 50, 57 can be made of polypropylene, polyethylene teraphthalate (PET) or other polymer film materials typically used in the packaging industry. In one embodiment of the invention, discrete pieces of the electroluminescent material 35, each designed to present a discrete image, are sandwiched between two layers of polymer material at regulated intervals. This can be accomplished using a film converter, thus building a single flexible sheet of polymer material having the electroluminescent film 35 embedded therein. Likewise, the power system used to illuminate the electroluminescent film 35 can be electrically connected to the electroluminescent film 35 and placed between the two polymer layers such that all of the elements required to provide for electroluminescence on a formed package are embedded between the two polymer layers. The thus formed flexible film sheet can then be fed into a form and fill machine, such as a vertical form, fill, and seal machine, resulting in the formation of a package or bag having the electroluminescent image feature.

Returning to FIG. 3, to produce colorful images, the outer sealing layer 50 may contain color pigments, and different areas of the layer 50 may be pigmented with different colors; alternatively, some areas may be left clear. Because the inside layer 57 may encounter a different environment than the outside layer 50, the inner and outer sealing layers 50, 57 may also be of different materials. For example, in the snack food bag embodiment displayed in FIG. 2*a*, the outside sealing layer 50 can protect against dust, dirt, moisture, and abrasion. Thus the outside layer 50 might be 15–40 microns. The inner layer 57, on the other hand, may come in contact with salt and grease from the food product inside the bag 30, thus 15–50 microns might be more appropriate for the inner layer 57. Any common film-packaging desiccant can be used for the two desiccant layers 51, 56, such as talc, moisture absorbing coatings such as PVOH, or moisture absorbing resins such as EVOH, PET, or Nylon. Even the product itself can act as a desiccant, thereby eliminating the need for desiccant layers 51, 56.

The front electrode 52 preferably is a transparent electrode such as conductive polyester, but any relatively clear and conductive film layer will suffice. This front electrode layer 52 may also be tinted with color if so desired. The electroluminescent layer 53 preferably consists of phosphor particles that illuminate when energized by electrical current. However, fluorescent pigments or luminophores may also be used. The composition of the electroluminescent layer 53 can be adjusted to produce different colors upon illumination. Under the electroluminescent layer 53 is an insulation layer 54 that preferably consists of a dielectric material. However, the electroluminescent material may be dispersed within the insulating dielectric material; therefore it is possible for the electroluminescent layer 53 and the insulation layer 54 to be combined into one layer. The rear electrode layer 55 preferably consists of a reflective metallic layer such as silver. However, the rear electrode 55 instead may be opaque, translucent, or clear. For example, a carbon electrode layer may be used for the rear electrode 55.

In a preferred embodiment, the electroluminescent film 35 must be thin enough to use on a film converter and a standard vertical form, fill, and seal machine with little adjustment. The thickness of each layer relative to the other layers does not have to conform to the relative thickness as shown in FIG. 3. In the embodiment illustrated, the thickness of each layer would be as follows: outer sealing layer 50, between 15–40 microns; outer desiccant 51, between 1–10 microns; front electrode 52, between 1–5 microns; electroluminescent material 53, 3–15 microns; insulation 54, between 1–5 microns; rear electrode 55, between 1–5 microns; inner desiccant 56, between 1–10 microns; and inner sealing layer 57, between 15–50 microns. However, the thickness of each layer may vary beyond these prescribed ranges depending on the properties desired and the materials used.

The polymer film layers that enclose the electroluminescent film 35 can, for example, comprise oriented polypropylene as an outside layer and PET as an inside, or product side, layer. Each polymer film layer can, in fact, comprise more than one discrete film layer laminated to one or more additional film layers, as is well known in the art. The outer polymer film layer will typically incorporate an ink layer or other pigmentation to enhance the graphic presentation. The selection of the polymer film material layers is not limited to that disclosed specifically herein but, rather, is driven by the selection of thin-film material with the appropriate combined barrier properties and graphics presentation capabilities for the particular application desired. In addition, those skilled in the art understand that a different combination of layers and layer dimensions may be used to create thin electroluminescent films. The resulting film must still be thin enough and flexible enough, when combined with polymer film layers, to form a single flexible film sheet to be used in conventional packaging machines, such as the Universal Bag Maker form, fill, and seal machine by Woodman.

The preferred embodiment of the invention thereby incorporates all of the individual components required to provide electroluminescence on a package within a single sheet of flexible film. As noted previously, the invention can be constructed using conventional film converters. Therefore, a sheet of flexible film incorporating all of the previously described features can be provided in rolls adaptable for use on vertical form, fill, and seal machines. The sheet is fed into the form and fill machine and then sealed into a tube, sealed at one end, filled, sealed at the other end, and cut, all as is well known in the art. The end result is a flexible film package, such as the common potato chip bag, incorporating all of the individual elements, such as the battery, inverter, switch, and electroluminescent material, within the packaging film. The elements necessary for the electroluminescent feature need be located only in portions of the film, therefore not increasing the thickness of the film at critical seal areas. Consequently, with certain embodiments of the invention, no adjustment of pressure or dwell times is needed at the seal jaws or other sealing surfaces of a form and fill machine using the flexible film of the present invention for applications with existing product lines.

FIG. 4 depicts an embodiment of a snack food package wherein the power components are not thin-film components sandwiched within the packaging film but, instead, are located elsewhere. For example, FIG. 4 shows in phantom a button-type battery 71, a solid-state inverter 72, and electrical wires 73 located inside a snack product bag and attached to one of the bag walls. The electrical wires 73 connect both battery 71 and inverter 72 to the electroluminescent image 11 via connecting electrodes 74. The connecting electrodes 74 run from outside the film 31, through the various film layers shown in FIG. 3, and to the front and rear electrode layers 52, 55 of FIG. 3 in order to connect the outside power source 71, 72, 73 to the electroluminescent image 11 within the packaging film layers 31. While FIG. 4 shows the battery 71, inverter 72 and wires 73 attached to the inside wall of the snack product bag, those components may alternatively be attached to the outside of the bag or sandwiched between polymer layers.

Figure 5A:
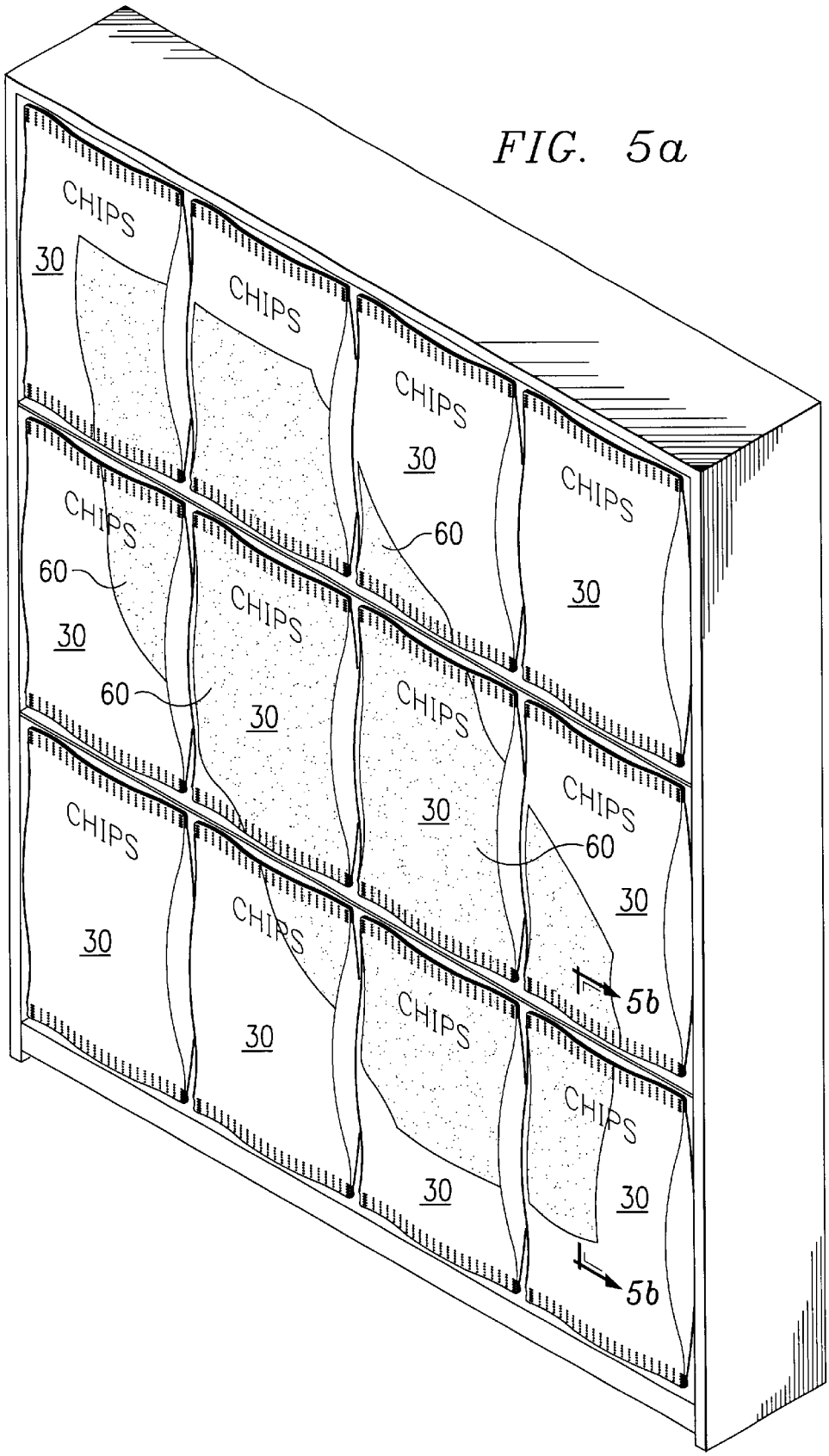
FIG. 5*a* is a perspective view of a display shelf with several snack food bags that incorporate one embodiment of the flexible electroluminescent film of the present invention arranged in a collage presentation.
Figure 5B:
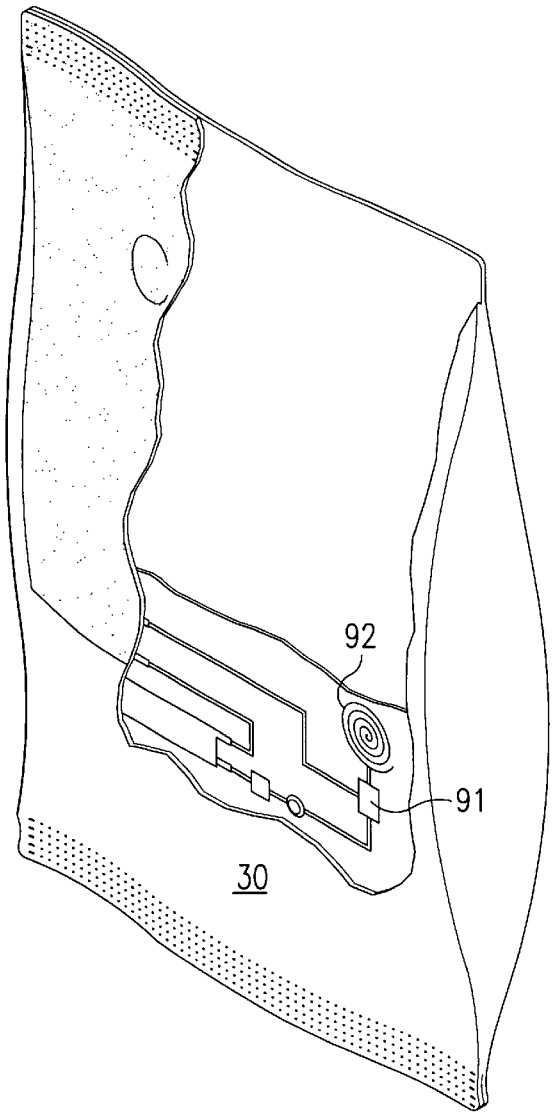
FIG. 5*b* is a perspective view of one of the bags in FIG. 5*a* with a section of the first few layers of the film removed, along the line (5*b*—5*b*) indicated on FIG. 5*a,* to show various components.

FIG. 5*a* depicts an illuminated collage effect that is possible across a display of snack product bags 30 incorporating flexible electroluminescent features 60. No single bag displays the complete image, but the complete image appears over many bags 30 collectively arranged. There are several methods for accomplishing this collage effect. In one embodiment, each bag 30 in the collage has a fixed and predetermined image displayed on the flexible electroluminescent features 60. The image on any given bag may be different from the image on another bag. When arranged in a particular fashion, each bag 30 contributes to an overall image, much like each piece of a jigsaw puzzle contributes its partial image to form a larger picture. In another embodiment, each bag 30 has several different image layers that can be illuminated. The location of each bag 30 within the collage display would determine which image is displayed. Each image layer would consist of a front electrode layer, an electroluminescent layer, an insulation layer, a rear electrode layer, and another insulation layer, all sandwiched within the inner and outer package film layers. In order for the illuminated image layer to be visible through the non-illuminated image layers, all image layers except for the inner-most layer should use transparent electrode layers. The individual bags 30 can also be programmed to illuminate in sequence, thus creating a rolling effect or other animated presentation for the entire collage.

FIG. 5*b* depicts a close up view of one of the chip bags 30 within the collage with the outer film layers cut away along a line (5*b*—5*b*) as shown in FIG. 5*a*. As shown in FIG. 5*b*, an integrated circuit 91 can be sandwiched within the packaging sheet to control which image layer is illuminated. If the collage display appears in a supermarket isle, for example, a nearby radio control device can transmit radio signals to the radio receivers 92, which are incorporated into the film layers. Although FIG. 5*b* depicts a remote-control system using a radio receiver 92 and integrated chip 91, other forms and methods of controlling which images are illuminated are also possible. Those skilled in the art know equivalent means for selectively energizing different circuits, which in turn illuminate different images within the flexible packaging layers.

Figure 6:
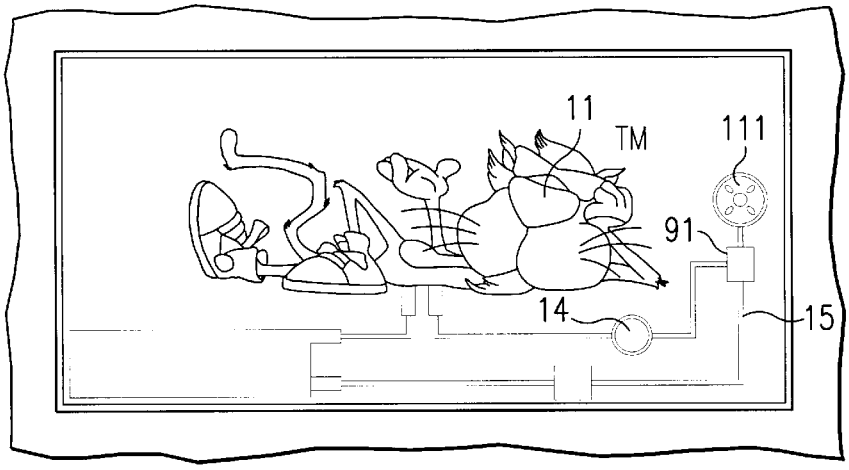
FIG. 6 is a schematic view of the flexible electroluminescent film of one embodiment of the present invention with an integrated chip and speaker included.

There are limitless uses for flexible electroluminescent films in packages. FIG. 6 depicts an embodiment incorporating a thin speaker 111 and integrated circuit 91 within the film layers in addition to the features shown in FIG. 1. Both the image 11 and the speaker 111 may be switched on and off by one or more switches 14, such as membrane switches made by Memtronic of Montreal, Canada, or membrane switches made by Flexible Circuit Technologies of Saint Paul, Minn. Alternatively, an oxygen sensor might take the place of one or more switches 14, and the circuitry 15, 91 could be designed to either turn off or turn on the image 11 and/or speaker 111 if the sensor senses a certain level of oxygen within the bag. When such an oxygen sensor is incorporated into a snack bag 30 like the ones depicted in FIGS. 4–5*b*, the flexible electroluminescent film 10 itself acts as a freshness-assessing device. Additional switches 14 can be used in combination with specialized circuitry 15, 91 in order to provide a simple video game on the surface of a package. Such circuitry 15, 91 can also be designed for use with a coupon or game promotion, whereby the consumer energizes the electroluminescent image 11 in order to indicate what prize or coupon has been won.

While the invention has been particularly shown and described with reference to a preferred embodiment, it will be understood by those skilled in the art that various changes in form and detail may be made therein without departing from the spirit and scope of the invention.

We claim:

1. A flexible film sheet comprising:

a first polymer film layer;

a first electrode film layer bound to said first polymer film layer;

an electroluminescent material layer bound to said first electrode film layer;

a second electrode film layer bound to said electroluminescent material layer;

a second polymer film layer bound to said second electrode layer;

a power source electrically connected to said electroluminescent material; and wherein said flexible film sheet is suitable for use in a vertical form, fill, and seal packaging machine, and the power source further comprises a thin-film DC power source.

2. The flexible film sheet of claim 1 wherein the power source further comprises a thin-film current inverter electrically connected to the DC power source and the electroluminescent material layer.

3. The flexible film sheet of claim 2 wherein the film further comprises a circuit, said circuit located between said first polymer layer and said second polymer layer, for conducting a current from the DC power source, through the inverter, to the electroluminescent material, and back to the DC power source.

4. The flexible film sheet of claim 1 wherein the flexible film further comprises a thin-film switch electrically connected to said DC power source and located between said first polymer layer and said second polymer layer.

5. The flexible film sheet of claim 1 wherein the flexible film further comprises an integrated circuit electrically connected to said DC power source and located within said film layers.

6. The flexible film sheet of claim 1 wherein the flexible film further comprises a thin-film radio receiver electrically connected to said DC power source and located between said first polymer layer and said second polymer layer.

7. The flexible film sheet of claim 1 further comprising a thin-film speaker electrically connected to said DC power source and located between said first polymer layer and said second polymer layer.

8. A flexible package for containing a product, said package comprising:

a first polymer layer;

a second polymer layer;

an electroluminescent thin film sandwiched between said first polymer layer and said second polymer layer;

a power source electrically connected to said electroluminescent thin film;

wherein said first polymer layer, second polymer layer, and electroluminescent film are bound together and arranged to form said flexible package.

9. The flexible package of claim 8 wherein the power source comprises a thin-film DC power source electrically connected to an inverter.

10. The flexible package of claim 8 further comprising a switch electrically connected to said power source, whereby such switch controls the input of power into the electroluminescent film.

11. The flexible package of claim 8 wherein said package comprises a bag for containing a snack food product.

12. The flexible package of claim 8 further comprising an integrated circuit electrically connected to the power source.

13. The flexible package of claim 8 further comprising a radio receiver electrically connected to the power source.

14. The flexible package of claim 8 further comprising a speaker electrically connected to the power source.

15. A method for producing a flexible package, said package comprising two polymer film layers, said method comprising the steps of:

a) placing between the two polymer film layers an electroluminescent film and a thin film power supply, wherein said electroluminescent film and power supply are electrically connected;

b) sealing the two polymer film layers together, thereby encasing the electroluminescent film and power supply within the two layers and forming a sheet of thin-film, flexible material;

c) feeding said sheet of thin-film, flexible material into a form, fill, and seal machine; and d) forming a package from said sheet of thin-film, flexible material.

16. The method for producing a flexible package of claim 15 wherein step d) further comprises forming a snack food product package.

17. The method for producing a flexible package of claim 15 wherein step a) further comprises placing between the two polymer film layers an integrated circuit electrically connected to the electroluminescent film and power supply.

18. The method for producing a flexible package of claim 15 wherein step a) further comprises placing between the two polymer film layers a thin-film switch electrically connected to the electroluminescent film and power supply.

19. The method for producing a flexible package of claim 15 wherein step a) further comprises placing between the two polymer film layers a thin-film radio receiver electrically connected to the electroluminescent film and power supply.

20. The method for producing a flexible package of claim 15 wherein step a) further comprises placing between the two polymer film layers a thin-film speaker electrically connected to the electroluminescent film and power supply.

* * * * *